US005728219A

United States Patent [19]

Allen et al.

[11] Patent Number: 5,728,219

[45] Date of Patent: Mar. 17, 1998

[54] MODULAR DIE FOR APPLYING ADHESIVES

[75] Inventors: Martin A. Allen; John T. Fetcko, both of Dawsonville, Ga.

[73] Assignee: J&M Laboratories, Inc., Dawsonville, Ga.

[21] Appl. No.: 532,369

[22] Filed: Sep. 22, 1995

[51] Int. Cl.[6] ..... B05B 7/06; B28B 5/00

[52] U.S. Cl. ..... 118/315; 118/300; 425/72.2; 425/7; 425/382.2; 425/464

[58] Field of Search ..... 118/315, 313, 118/300; 425/7, 66, 72.2, 192 S, 461, 382.2, 145, 467, 464; 264/12, 211.14

[56] References Cited

U.S. PATENT DOCUMENTS

| | | | |
|---|---|---|---|
| 4,687,137 | 8/1987 | Boger et al. | 239/124 |
| 4,785,996 | 11/1988 | Ziecker et al. | 239/298 |
| 4,818,463 | 4/1989 | Buehning | 264/40.1 |
| 4,891,249 | 1/1990 | McIntyre | 427/421 |
| 4,949,668 | 8/1990 | Heindel et al. | 118/314 |
| 4,983,109 | 1/1991 | Miller et al. | 425/7 |
| 5,102,484 | 4/1992 | Allen et al. | 156/244.11 |
| 5,145,689 | 9/1992 | Allen et al. | 425/72.2 |
| 5,160,746 | 11/1992 | Dodge et al. | 425/7 |
| 5,236,641 | 8/1993 | Allen et al. | 425/72.2 |
| 5,445,509 | 8/1995 | Allen et al. | 425/72.2 |

FOREIGN PATENT DOCUMENTS

| | | | |
|---|---|---|---|
| 0579012A1 | 1/1994 | European Pat. Off. . | |
| 1563686 | 10/1969 | France . | |
| 8534594 U | 3/1986 | Germany | B29C 41/08 |

OTHER PUBLICATIONS

"Application Potential of Controlled Fiberization Spray Tech," J. Raterman, Jan., 1988, 3 pages.

"The Controlled Fiberization of Pressure–Sensitive Hot–Melt Adhesives," J. Raterman, 5 pages.

"Disposables Manufacturers from All Over the World," Nordson Corp. (1993), 3 pages.

*Primary Examiner*—Donald E. Czaja
*Assistant Examiner*—Calvin Padgett
*Attorney, Agent, or Firm*—R. L. Graham

[57] ABSTRACT

A modular die for applying hot melt adhesive onto a substrate comprises (a) a manifold having adhesive and air passages formed therein, (b) a plurality of self-contained and interchangeable die bodies mounted on the manifold, and (c) a die head detachably mounted on each die body. The die heads are selected from melt spraying, meltblowing, and linear bead applicators permitting the application of a variety of adhesive patterns on the substrate.

11 Claims, 5 Drawing Sheets

MODULAR DIE FOR APPLYING ADHESIVES

BACKGROUND OF THE INVENTION

This invention relates generally to dies and methods for applying hot melt adhesives to a substrate. In one aspect the invention relates to a die provided with at least two different types of applicator heads. In another aspect, the invention relates to modular die bodies with interchangeable die heads.

The deposition of hot melt adhesives onto substrates has been used in a variety of applications including diapers, sanitary napkins, surgical drapes, and the like. This technology has evolved from the application of linear beads such as that disclosed in U.S. Pat. No. 4,687,137, to air assisted deposition such as that disclosed in U.S. Pat. No. 4,891,249, to spiral deposition such as that disclosed in U.S. Pat. No. 4,949,668 and 4,983,109. More recently, meltblowing dies have been adapted for the application of hot melt adhesives (see U.S. Pat. No. 5,145,689).

At the present, the most commonly used adhesive applicators are intermittently operated air assisted dies. Each of the applicators has its own advantages and disadvantages. The meltblown applicators provide a generally uniform covering of a predetermined width of the substrate, but do not provide precise edge control which is needed or desirable in some applications. On the other hand, the spiral nozzles deposit a controlled spiral bead on the substrate giving good edge control but not uniform coverage on the substrate surface.

As indicated above, an essential feature of the present invention is the employment of two different types of die heads (e.g., a meltblowing die head and a spiral nozzle). The term "head" is used herein to describe the part of the applicator which determines the pattern of adhesive deposition (e.g. spray, bead, spiral or meltblown). The heads for spray and spiral deposition are specially shaped nozzles. The head for meltblown applicators are die tip assemblies designed to meltblow a row of filaments onto the substrate.

Meltblowing is a process in which high velocity hot air (normally referred to as "primary air") is used to blow molten fibers extruded from a die onto a collector to form a web or onto a substrate to form a coating or composite. The process employs a die provided with (a) a plurality of openings (e.g. orifices) formed in the apex of a triangular shaped die tip and (b) flanking air passages. As extruded rows of melt of the polymer melt emerge from the openings, the converging high velocity hot air from the air passages contacts the filaments and by drag forces stretches and draws them down forming microsized filaments. In some meltblowing dies, the openings are in the form of slots. In either design, the die tips are adapted to form a row of filaments which upon contact with the converging sheets of air are carried to and deposited on a collector or a substrate in a random manner.

Meltblowing technology was originally developed for producing nonwoven fabrics but recently has been utilized in the meltblowing of adhesives onto substrates.

In meltblowing adhesives, the filaments are drawn down to their final diameter of 5 to 50.0 microns, preferably 10 to 20.0 microns, and are deposited at random on a substrate to form an adhesive layer thereon onto which may be laminated another layer such as film or other types of materials or fabrics.

In the meltblowing of polymers to form nonwoven fabrics, the polymers, such as polyolefin, particularly polypropylene, are extruded as filaments and drawn down to an average fiber diameter of 0.5 to 10 microns and deposited at random on a collector to form a nonwoven fabric. The integrity of the nonwoven fabric is achieved by fiber entanglement with some fiber-to-fiber fusion. The nonwoven fabrics have many uses, including oil wipes, surgical gowns, masks, filters, etc.

The filaments extruded from the die may be continuous or discontinuous. For the purpose of the present invention the term "filament" is used interchangeably with the term "fiber" and refers to both continuous and discontinuous strands.

The meltblowing process grew out of laboratory research by the Naval Research Laboratory which was published in Naval Research Laboratory Report 4364 "Manufacture of Superfine Organic Fibers", Apr. 15, 1954. Exxon Chemical Company developed a variety of commercial meltblowing dies, processes, and end-use products as evidenced by U.S. Pat. Nos. 3,650,866, 3,704,198, 3,755,527, 3,825,379, 3,849,241, 3,947,537, and 3,978,185. Other representative meltblowing patents include U.S. Pat. Nos. 3,942,723, 4,100,324 and 4,526,733.

U.S. Pat. No. 5,145,689 discloses dies constructed in side-by-side units with each unit having separate polymer flow systems including internal valves.

Another popular die head is a spiral spray nozzle. Spiral spray nozzles, described in U.S. Pat. Nos. 4,949,668 and 5,102,484, operate on the principle of a thermoplastic adhesive filament being extruded through a nozzle while a plurality of hot air streams are angularly directed onto the extruded filament to impart a circular or spiral motion thereto. The filaments thus assume an expanding swirling cone shape pattern and moving from the extrusion nozzle to the substrate. As the substrate is moved in the machine with respect to the nozzle, a circular or spiral or helical bead is continuously deposited on the substrate, each circular cycle being displaced from the previous cycle by a small amount in the direction of substrate movement. As indicated above, the meltblowing heads offer superior coverage whereas the spiral nozzles provide better edge control.

SUMMARY OF THE INVENTION

The modular die assembly constructed according to the present invention comprises three main components: (1) a hot melt adhesive and air manifold, (2) a plurality of self-contained die body modules, and (3) a plurality of die heads, one for each module and selected from meltblowing die heads, and spiral nozzle heads. In another embodiment, the assembly comprises a third type of die head—a linear bead applicator.

The die body modules are substantially identical and interchangeable, and are mounted on the manifold in side-by-side relationship. Each module is self-contained and includes an internal valve for controlling the flow of polymer therethrough. The manifold provided with appropriate passages delivers polymer and air to each module body.

In a preferred embodiment, a plurality of the modules are provided with meltblowing heads and arranged to deposit filaments discharged therefrom in a random pattern forming a generally uniform layer traversing a predetermined width of the underlying substrate. At least one of the modules is provided with a spiral nozzle head. Preferably, the die assembly is provided with two spiral nozzle heads positioned in flanking relationship to a plurality of the meltblowing modules. This results in the deposition of a controlled bead at opposite edges of the layer of meltblown filaments, thereby providing good edge control.

In still another embodiment of the invention, the assembly includes a third type of head, one for depositing a bead (unassisted by air) onto the substrate.

It is important to recognize that the construction of the die according to the present invention permits the selective adaptation of two or three or more types of heads by varying only the head itself on the die body module. Thus, the length of the die as well as the pattern may be controlled by merely selecting the proper number of die bodies and selecting the die heads for each module. Changes in the pattern can be achieved by merely changing the die heads of the module.

The method of the present invention involves meltblowing from a meltblowing die, a polymeric hot melt adhesive onto a substrate moving under the die wherein the polymeric hot melt adhesive is deposited on the substrate in random filaments forming a generally uniform layer of meltblown adhesives on a predetermined width of the substrate, while simultaneously melt spraying from a spiral spray nozzle positioned adjacent the meltblowing die, a spiral bead to deposit a spiral bead adjacent one edge of the meltblown layer.

In one aspect the modular die assembly constructed according to the present invention may be viewed as comprising first and second interchangeable die body modules mounted on a manifold and a first meltblowing die head mounted on the first die body module and a spray nozzle head mounted on the second die body module. By varying the number and positions of the meltblowing die heads and the spray nozzles on the interchangeable die body modules, a wide variety of adhesive patterns and widths of the adhesive may be deposited on the substrate. In a further aspect of the invention a third type of die head (non air-assisted) may be incorporated in the array by merely replacing one of the air-assisted die heads (i.e. meltblowing or spray nozzle) with a bead die. The invention thus offers the operator an inexpensive, highly versatile modular die assembly.

DESCRIPTION OF THE PREFERRED EMBODIMENTS

Figure 1:
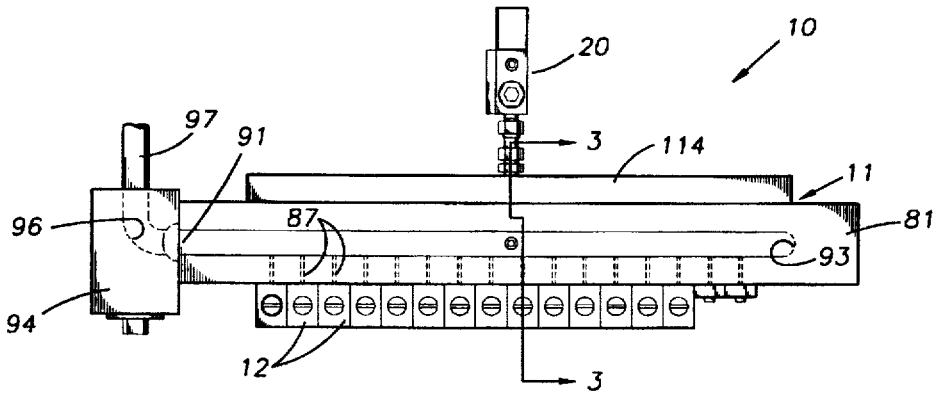
FIG. 1 is a top plan view of a meltblowing modular die assembly constructed according to the present invention.
Figure 2:
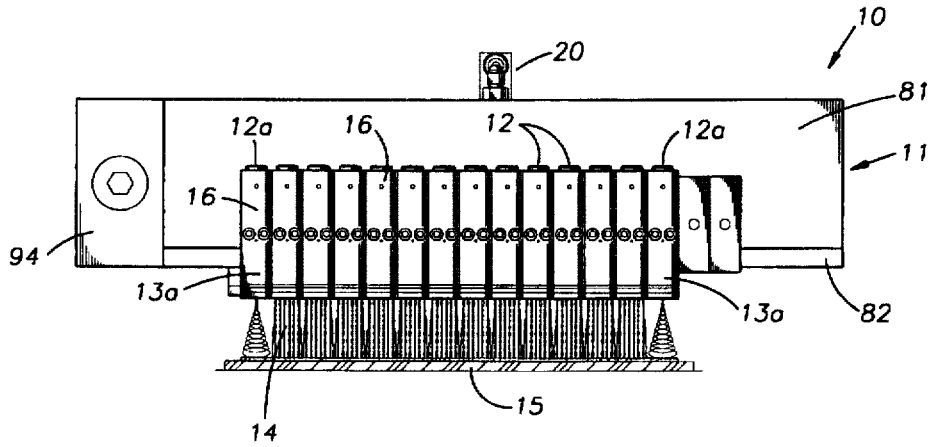
FIG. 2 is a front elevation view of the meltblowing modular die shown in FIG. 1.
Figure 3:
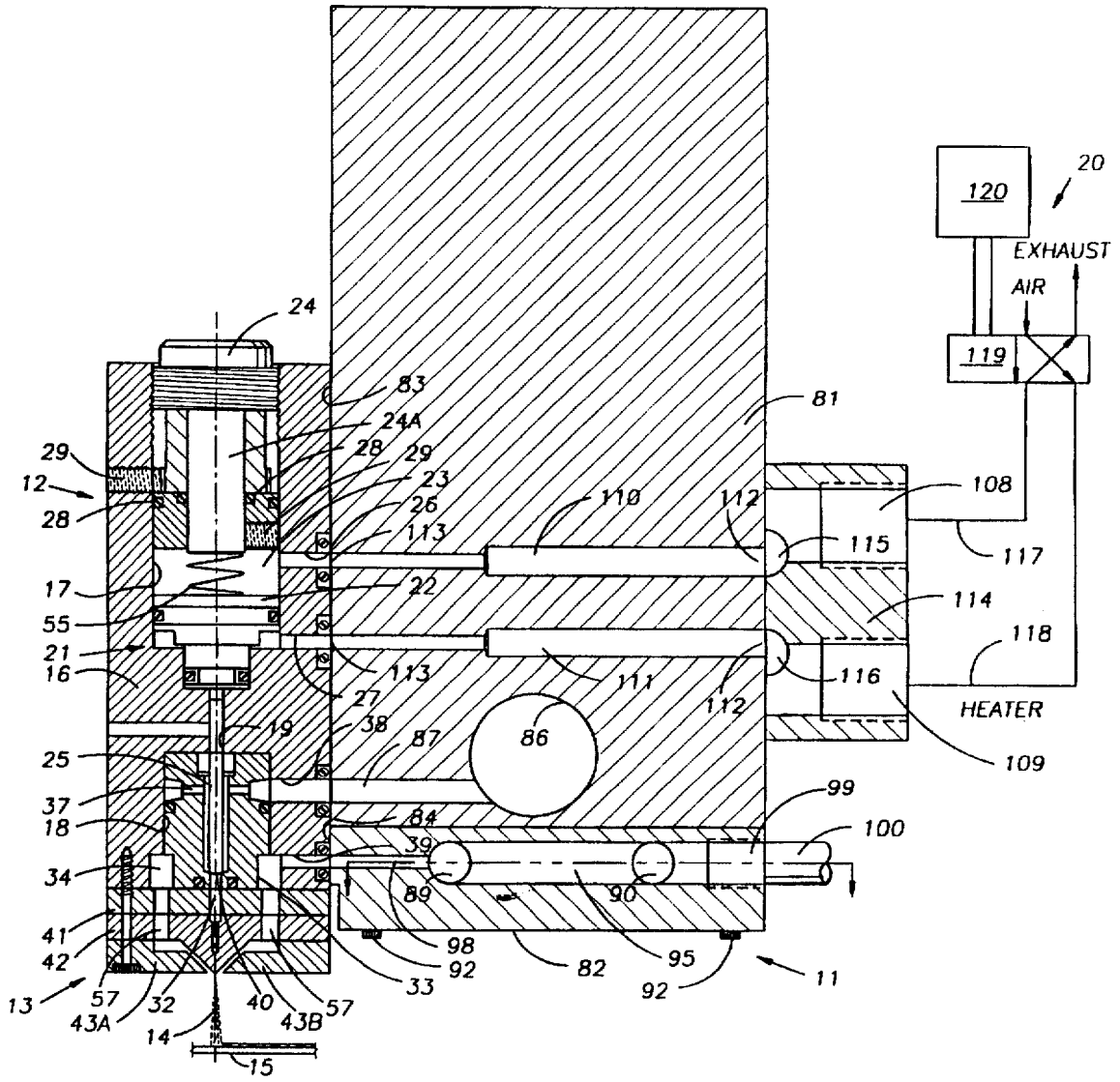
FIG. 3 is an enlarged sectional view of the modular die shown in FIG. 1 with cutting plane indicated by 3—3 thereof.

With reference to FIGS. 1 and 2, the modular die assembly 10 of the present invention comprises a manifold 11, a plurality of side-by-side self-contained die body modules 12, and a valve actuator assembly including actuator 20 for controlling the polymer flow through each module 12. As best seen in FIG. 3, each module 12 includes a die body 16 and a die tip assembly 13 for discharging a plurality of filaments 14 onto a substrate 15 (or collector). The manifold 11 distributes a hot melt adhesive polymer melt and hot air to each of the modules 12. Returning to FIG. 2, the modular die 10 includes meltblowing die tip assemblies 13 mounted on most of the die bodies 16. Representative of a preferred embodiment, flanking die bodies 16 have swirl nozzles 13A mounted thereon to provide edge control. Each of these components and variations thereof are described in detail below. Meltblown filaments 14 may be continuous or discontinuous strands, but the spiral filaments are generally continuous. The term "polymer" used herein refers to hot melt adhesives.

Die Body Modules:

Referring to FIG. 3, die body 16 has formed therein an upper circular recess 17 and a lower circular recess 18 which are interconnected by a narrow longitudinal extending opening 19. The upper recess 17 defines a cylindrical chamber 23 which is closed at its top by threaded plug 24. A valve assembly 21 mounted within chamber 23 comprises piston 22 having depending therefrom stem 25. The piston 22 is reciprocally movable within chamber 23, with adjustment pin 24A limiting the upward movement. Conventional o-rings 28 may be used at the interface of the various surfaces for fluid seals as illustrated. Threaded set screws 29 may be used to anchor cap 24 and pin 24A at the proper location within recess 17.

Side ports 26 and 27 are formed in the wall of the die body 16 to provide communication to chamber 23 above and below piston 22, respectively. As described in more detail below, the ports 26 and 27 serve to conduct air (referred to as instrument gas) to and from each side of piston 22. Details of the valve assembly 21 are described in more detail in U.S. Pat. No. 5,269,670, the disclosure of which is incorporated herein by reference.

Figure 4:
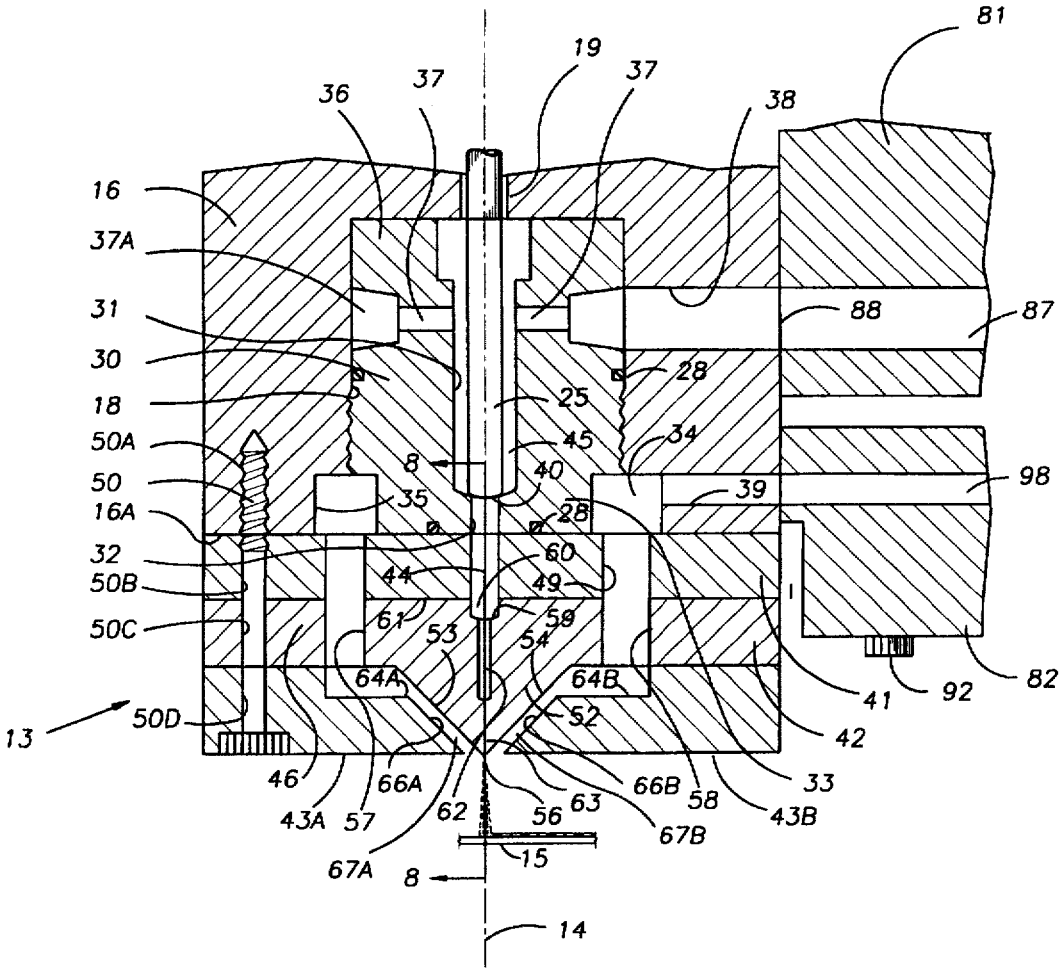
FIG. 4 is an enlarged view of FIG. 3, illustrating internal features of the die tip assembly.
Figure 5:
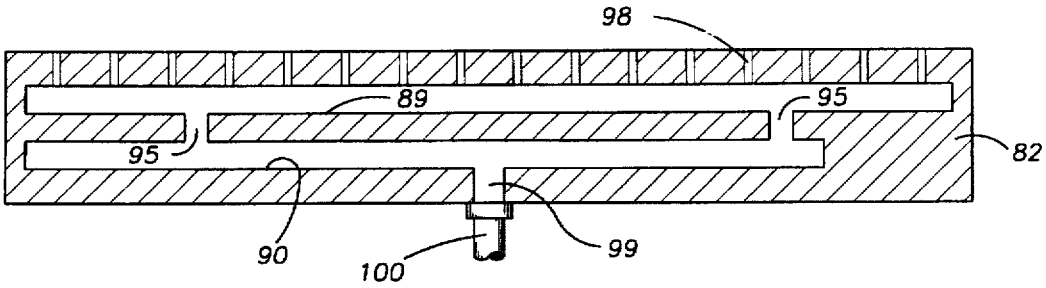
FIG. 5 is a horizontal sectional view of the manifold of the meltblowing die assembly with the cutting plane taken along 5—5 of FIG. 3.
Figure 6:
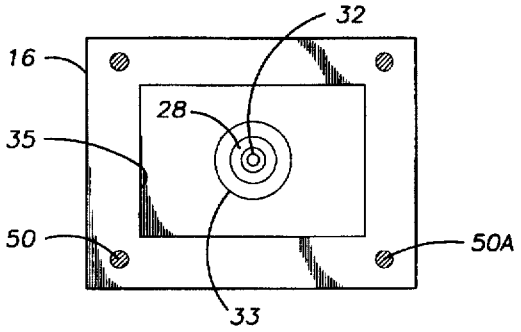
FIGS. 6 and 7 are sectional views of the module shown in FIG. 4 with the cutting planes shown by lines 6—6 and 7—7 thereof, respectively.

Referring to FIGS. 4 and 5, lower recess 18 is formed with downwardly facing surface 16A of body 16. This surface serves as the mounting surface for attaching the die tip assembly 13 to the die body 16. Mounted in the lower recess 18 is a threaded valve insert member 30 having a central opening 31 extending axially therethrough and terminating in valve port 32 at its lower extremity. A lower portion 33 of insert member 30 is of reduced diameter and in combination with die body inner wall 35 defines a downwardly facing cavity 34 as shown in FIG. 6. Threaded bolt holes 50A formed in the mounting surface **16*a* of the die body receive bolts 50. As described later, bolts 50 maintain the die tip assembly 13 in stacked relationship and secured to the die body 16. Upper portion 36 of insert member 30 abuts the top surface of recess 18 and has a plurality (e.g. 4) of circumferential ports 37 formed therein and in fluid communication with the central passage 31. An annular recess 37A extends around the upper portion 36 interconnecting the ports 37**.

Valve stem 25 extends through body opening 19 and axial opening 31 of insert member 30, and terminates at end 40 which is adapted to seat on valve port 32. The annular space 45 between stem 25 and opening 31 is sufficient for polymer melt to flow therethrough. End 40 of stem 25 seats on port 32 with piston 22 in its lower position within chamber 23 as illustrated in FIG. 4. As discussed below, actuation of the valve moves stem end 40 away from port 32 (open position), permitting the flow of polymer melt therethrough. Side port 38 formed in die body 16 communicates with recess 37A and ports 37, through annular space 45 discharging through port 32 into the die tip assembly via port 44. Spring 55 (FIG. 3) interfaced between cap 24 and the top of piston 22 imparts a downward force on piston 22 to normally seat valve tip 40 on port 32. Conventional o-rings 28 may be used at the interface of the various surfaces as illustrated in the drawings.

Die Heads:

While the body modules 16 may be substantially identical and interchangeable, the heads are quite different and are selected to produce the desired array of mixed patterns. However, each die head must be constructed to be mounted on the mounting surface of each module. Air-assisted and non air-assisted die heads may be used. The air-assisted heads useable in the present invention comprise meltblowing die heads and melt spray nozzles. In meltblowing heads (i.e. die assembly 13), the adhesive is distributed laterally in the head prior to discharge, so that the hot melt adhesive is discharged as a curtain of filaments. In melt spray nozzles the adhesive is discharged from the nozzle and then distributed laterally by air jets. The distribution preferably is in the form of a spiral or helic as described in U.S. Pat. Nos. 4,983,109 or 5,102,484.

Figure 7:
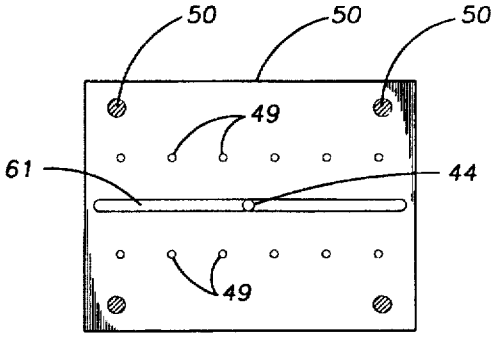

The meltblowing die tip assembly 13, as best seen in FIGS. 4 and 7, comprises a stack-up of four parts: a transfer plate 41, a die tip 42, and two air plates 43A and 43B. The assembly 13 can be pre-assembled and adjusted prior to mounting onto the die body 16.

The transfer plate 41 is a thin metal member having a central polymer port 44 formed therein. Two rows of air holes 49 flank the opening 44 as illustrated in FIG. 7. When mounted on the lower mounting surface 16A of the die body 16, the transfer plate 41 covers the cavity 34 and therewith defines an air chamber with the air holes 49 providing outlets for air from cavity 34. Opening 44 registers with port 32 with o-ring 28 providing a fluid seal at the interface surrounding port 32.

The die dip 42 comprises a base member 46 which is coextensive with the transfer plate 41 and the mounting surface 16A of die body 16, and a triangular nosepiece 52 which may be integrally formed with the base 46. The nosepiece 52 is defined by converging surfaces 53 and 54 which meet at apex 56, which may be discontinuous, but preferably is continuous along the die. The portions of the base 46 extending outwardly from the nosepiece 52 (as viewed in FIG. 5) serve as flanges for mounting the base to the assembly and provide means for conducting the air through the base 46. The flanges of the base 46 have air holes 57 and 58 and mounting holes 50*c* (one shown in FIG. 4) which register with the mounting holes 50B of the transfer plate 41 and 50A of body 16, as well as 50D of air plate 43A. The number, spacing, and positioning of the air holes 49 in the transfer plate 41 is such that in the assembled condition, the air holes 49 of transfer plate 41 register with the air holes 58, 58 of the die tip base 46.

The number of air holes formed in the transfer plate 41 and the die tip base 46 may vary within wide ranges, but from 0.5 to 10 air holes per inch as measured longitudinally along the die tip as viewed in FIG. 7, should be sufficient for most applications.

Although the apex 56 of the die tip 42 is discontinuous at the interface between modules, in the assembled position the inter-module spacing preferably is very small so the aggregate of the side-by-side modules is very similar in performance to a continuous die tip apex extending the full length of the die. The result is a meltblown produce with good uniformity over the die length.

Figure 10:
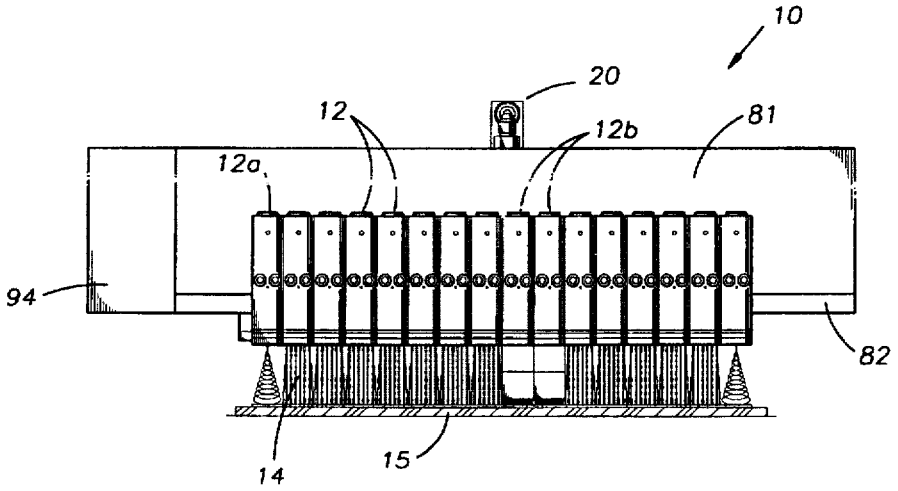
FIG. 10 is a front elevational view of the die assembly constructed according to the present invention and provided with three different heads.
Figure 8:
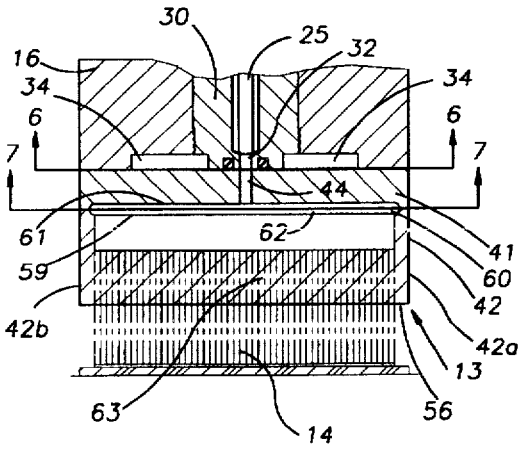
FIG. 8 is a sectional view of the die tip assembly of the module with the cutting plane taken along line 8—8 of FIG. 4.
Figure 9:
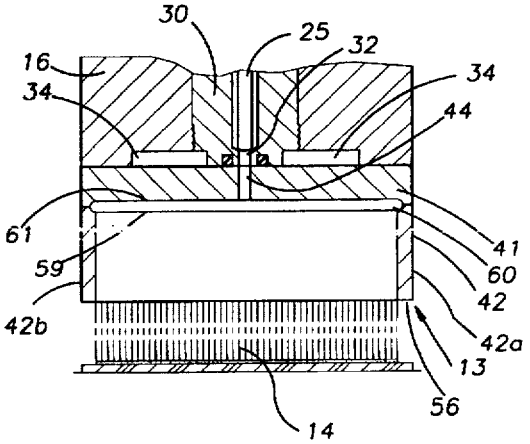
FIG. 9 is a view similar to FIG. 8 illustrating another embodiment of the die tip assembly construction.

As seen in FIGS. 4 and 8, a groove 59 is formed at the center of the die tip base 46 and extends in a longitudinal direction midway between the two rows of air holes 57 and 58. The top of the groove 59 is closed by a downwardly facing surface 61 of the transfer plate 41 defining a header chamber 60. Surface 61 may be flat or may be a longitudinal groove which mirrors groove 59 of the die tip as seen in FIG. 10. Header chamber 60 is fed at its mid point by opening 44 of the transfer plate 41 and thus serves to distribute the polymer melt entering the die tip 42 laterally therein.

Extending downwardly within the die tip 42 and coextensive with the groove 59, is an elongate channel 62. A plurality of orifices 63 formed along the apex of the nosepiece penetrate passage 62. The orifices 63 form a row of orifices spaced along the apex 56 for discharging polymer therefrom. The header channel 60 and channel 62 and row of orifices 63 in the apex may be coextensive extending substantially the full width of the die body 16 as viewed in FIG. 8.

Figure 11:
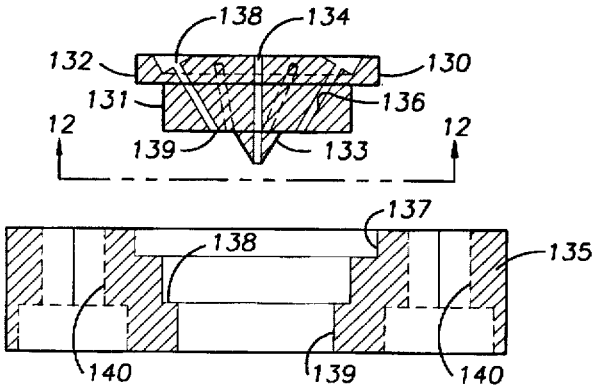
FIG. 11 is an exploded view, shown in section, of a spray nozzle useable in the present invention.

In lieu of orifices 63, a slot 65 may be formed extending longitudinally along the apex as shown in FIG. 11. The use of slot 65 may be preferred for processing materials with low viscosity or in applications where a large polymer throughput is required. The material discharging from slot 65 will generally not be in the form of finely divided filaments as in the case of orifices 63. However, for continuity the material discharged from slot 65 will be referred to as filaments since converging air sheets will tend to disperse the polymer into filament-like segments.

As has been mentioned, the inter-module spacing is very small and precise so that in the assembled die the orifice 63 spacing between meltblowing modules 12 is preferably the same as along the modules themselves. This is accomplished by designing the thickness of side walls 42A and 42B (see FIG. 8) to be small. The result is a substantially uniform meltblown film deposited on the substrate over the entire length of the meltblowing modules.

As illustrated in FIG. 4, the air plates 43A and 43B are in flanking relationship to the nosepiece and include confronting converging surfaces 66A and 66B. These surfaces in combination with the converging surfaces 53 and 54 of the nosepiece 52 define converging air slits 67A and 67B which meet at the apex 56. The inner surfaces of each air plate are provided with longitudinal recesses 64A and 64B which are aligned with air holes 57 and 58 in base 46. Air is directed to opposite sides of the nosepiece 52 into the converging slits 67A and 67B and discharged therefrom as converging air sheets.

The assemblage of the four components 41, 42, and 43A, 43B of the die tip assembly 13 may be accomplished by aligning up the parts and inserting bolts 50 through clearance holes 50B, 50C, and 50D into the threaded hole 50A. Tightening bolts 50 maintains the alignment of the parts. Alternatively, the die tip assembly 13 may be preassembled before attaching to body 16 by countersunk bolts extending downwardly from the transfer plate, through the die tip, and into the air plates with the base of the die tip sandwiched therebetween. The assemblage may then be attached to body 16 using bolts 50. This is the design disclosed in U.S. Pat. No. 5,145,689, the disclosure of which is incorporated herein by reference.

Note that the interface between the three components of the die tip assembly 13 do not need seals because the machine surfaces provide a seal themselves. It should also be observed that for purposes of this invention, the transfer plate 41 may be considered a part of the base of the die tip 42. A transfer plate 41 is used merely to facilitate the construction of the die tip assembly 13.

Figure 12:
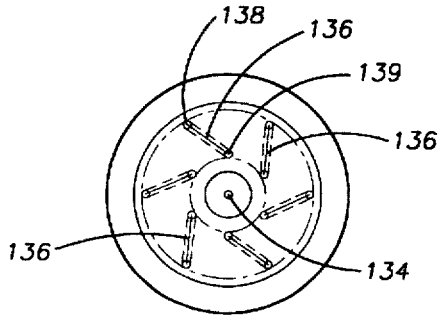
FIG. 12 is a bottom plan view of the spray nozzle insert shown from the plane of 12—12 of FIG. 11.
Figure 13:
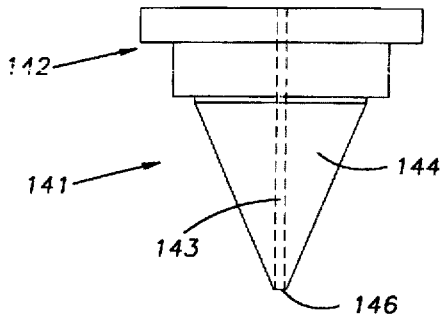
FIG. 13 is a side elevational view of a third type of nozzle useable in the die assembly of the present invention.

As shown in FIGS. 11 and 12, the nozzle for generating a spiral filament comprises a circular nozzle (Insert member 130) mounted in a retainer plate 135. The insert member 130 comprises a cylindrical body section 131 having protruding therefrom a cone 133. A flange member 132 surrounds the body member 131. Extending axially though the circular insert member 130 is a polymer passage 134 that discharges at the apex of cone 133. Angular air passages 136 extend through the body member and are angularly oriented with respect to the axis of polymer passage 134. The direction of the air passages 136 are such to impart a circular or helical motion to the polymer as the air from the plurality of air passages 136 contact the polymer discharging from the polymer passage 134. The orientation of the air passages with respect to the polymer filament can be in accordance with U.S. Pat. No. 5,102,484 or U.S. Pat. No. 4,983,109, the disclosures of which are incorporated herein by reference. Generally speaking, however, the angles may be defined by two intersecting vertical planes: one plane being defined by the axis of polymer passage 134 and air inlet 138, and the other plane being defined by air inlet 138 and air outlet 139. This angle will be an acute angle ranging from about 5° to 20°. The included angle in the vertical plane defined by inlet 138 and air outlet 139 will be between about 70° to 85° with respect to a horizontal plane.

The retainer plate 135 is adapted to be mounted on the module body 16 by bolts passing through bolt holes 140 positioned to align with threaded bolt holes 50A shown in FIGS. 4 and 6. With the nozzle 130 positioned in retainer plate 135 and mounted on surface 16A, air passage inlets 138 are in fluid communication with air cavity 34, and polymer flow passage is in fluid communication with port 32.

A bead or coating nozzle 141 (without air assistance) is disclosed schematically in FIG. 12. With this structure, the bead nozzle 141 is mounted in the retainer plate similar to the retainer plate 135. Nozzle 141 has a base portion 142 sized to fit into the plate 135 in the same manner as nozzle 131, and a polymer flow passage 143 extending axially therethrough, but has no air passages. When mounted on the die body 16, the inlet of flow passage 143 is in fluid communication with polymer flow passage port 32. The nozzle 141 has an inverted conical portion 144, through which passage 143 extends, exiting at the apex 146. Portion 144 extends to a position within about ½ to 1 inch from the substrate for depositing the bead or coating thereon. Since air is not used with this nozzle, the nozzle 141 in combination with the retainer plate 135 blocks out or seals the air chamber of the body unit. The bead nozzle 141 may be shaped to deposit a narrow bead or a wide bead.

Manifold:

As best seen in FIG. 3, the manifold 11 is constructed in two parts: an upper body 81 and a lower body 82 bolted to the upper body by spaced bolts 92. The upper body 81 and lower body 82 have mounting surfaces 83 and 84, respectively, which lie in the same plane for receiving modules 12.

As shown in FIGS. 1 and 3, the Upper body manifold body 81 has formed therein polymer header passage 86 extending longitudinally along the interior of body 81 and side feed passages 87 spaced along the header passage 86 for delivering polymer to each module 12. Each polymer feed passage 87 has an outlet 88 which registers with passage 38 of its associated module 12. The polymer header passage 86 has a side inlet 91 at one end of the body 81 and terminates at 93 near the opposite end of the body 81 (see FIG. 1). A connector block 94 bolted to the side of body 81 has a passage 96 for directing polymer from feed line 97 to the header channel 86. The connector block 94 may include a polymer filter. Polymer melt delivered to the die assembly flows from line 97 through passages 96 and 86 and in parallel through the side feed passages 87 to the individual modules 12.

Air is delivered to the modules 12 through the lower block body 82 of the manifold 11 as shown in FIGS. 3 and 5. The air passages in the lower block 82 are in the form of a network of passages comprising a pair of passages 89 and 90 interconnecting side ports 95, and module air feed ports 98 longitudinally spaced along bore 89. Air inlet passage 100 connects to air feed line 99 near the longitudinal center of block 82. Air feed ports 98 register with air passages 39 of its associated modular unit.

Heated air enters body 82 through line 100 and inlet 99. The air flows through passage 90, through side passages 95 and 96 into passage 89, and in parallel through module air feed ports 98. The network design of manifold 82 serves to balance the air flow laterally over the length of the die.

Valve Instruments:

The instrument air for activating valve 21 of each module 12 is delivered to the chamber 23 of each module 12 by air passages formed in the block 81 of manifold 11. As best seen in FIG. 3, instrument air passages 110 and 111 extend through the width of block 81 and each has an inlet 112 and an outlet 113. Outlet 113 of passage 110 registers with port 26 formed in module 12 which leads to chamber 23 above piston 22; and outlet 113 of passage 111 registers with port 27 of module 12 which leads to chamber 23 below piston 22. Thus each module 12 is fed by air passages 111 and 112 which extend parallel through the width of block 81. The inlets 112 of the instrument air passages form two parallel rows.

An instrument air block 114 is bolted to block 81 and traverses the full length of the rows of the instrument air inlets for passages 110 and 111 spaced along body 81. The instrument air block 114 has formed therein two longitudinal channels 115 and 116. With the block 114 bolted to body 81, channels 115 and 116 communicate with the instrument air passages 110 and 111, respectively, through inlets 112. Instrument tubing 117 and 118 (shown schematically in FIG. 3) deliver instrument air from control valve 119 to channels 115 and 116 which distribute the air to flow passages 110 and 111.

Control valve actuator 20 is illustrated schematically in FIG. 3. Actuator 20 comprises three-way solenoid air valve 119 coupled with electronic controls 120.

The valve 21 of each module 12 is normally closed with the chamber 23 above piston 22 being pressurized and chamber 23 below piston 22 being vented through valve control 119. Spring 55 also acts to maintain the closed position. To open the valves 21 of the modules 12, the 3-way control valve 119 is actuated by controls 120 sending instrument gas through tubing 118, channel 116, through passage 111, port 27 to pressurize chamber 23 below piston 22, while venting chamber 23 above piston 22 through port 26, passage 110, channel 115 and tubing 117. The excess pressure below piston 22 moves the piston and stem 25 upwardly opening port 32 to permit the flow of polymer therethrough.

In a preferred embodiment all of the valves are activated simultaneously using a single valve actuator 20 so that polymer flows through all the modules in parallel, or there is no flow at all through the die. In other embodiments, individual modules or groups of modules may be activated using multiple actuators 20 spaced along the die to control valves 21 of selected modules.

A particularly advantageous feature of the present invention is that it permits (a) the construction of a meltblowing die with a wide range of possible lengths using standard sized manifolds and interchangeable, self-contained modules, and (b) variation of die heads (e.g. meltblowing, spiral, or bead applicators) to achieve a predetermined and varied pattern. Variable die length and adhesive patterns may be important for coating substrates of different sizes from one application to another. The following sizes and numbers are illustrative of the versatility of modular construction.

| Die Assembly | Broad Range | Preferred Range | Best Mode |
|---|---|---|---|
| Number of Modules | 2–1,000 | 5–100 | 10–50 |
| Length of each Module (inches) | 0.25–1.50" | 0.5–1.00" | 0.5–0.8" |
| Orifice Diameter (inches) | 0.005–0.050" | 0.01–0.040" | 0.015–0.030" |
| Orifices/Inch* | 5–50 | 10–40 | 10–30 |
| Different Types of Heads | 2–4 | 2–3 | 2 |

*filaments per inch for slot.

Depending on the desired length of the die, standard sized manifolds may be used. For example, a die length of one meter could employ 54 modules mounted on a manifold 40 inches long. For a 20 inch die length 27 modules would be mounted on a 20 length manifold.

For increased versatility in the present design, the number of modules mounted on a standard manifold (e.g. one meter long) may be less than the number of module mounting places on the manifold. If, however, the application calls for only 14 modules, two end stations may be sealed using plates disposed sealingly over the stations and secured to the die manifold using bolts. Each plate will be provided with a gasket or other means for sealing the air passages 98, polymer passage 87, and instrument air passages 110 and 111.

The plates may also be useful in the event a module requires cleaning or repair. In this case the station may be sealed and the die continue to operate while the module is being worked on.

The die assembly may also include electric heaters (not shown) and thermocouple (not shown) for heat control and other instruments. In addition, air supply line 97 may be equipped with an in-line electric or gas heater.

Assembly and Operation:

As indicated above, the modular die assembly can be tailored to meet the needs of a particular operation. As exemplified in FIGS. 1 and 2, twelve meltblowing modules 12, each about 0.74 inches in width, are mounted in side-by-side relation on a 13" long manifold with flanking spiral modules 12A. The lines, instruments, and controls are connected and operation commenced. A hot melt adhesive is delivered to the die 10 through line 97, hot air is delivered to the die through line 99, and instrument air or gas is delivered through lines 117 and 118.

Actuation of the control valves opens port 32 of each module as described previously, causing polymer melt to flow through each module 12 and 12A. In the meltblowing modules 12, the melt flows in parallel streams through manifold passages 87, through side ports 38, through passages 37 and annular space 45, and through port 32 into the die tip assembly via passage 44. The polymer melt is distributed laterally in header channels 60 and 62 and discharges through orifices 63 as side-by-side filaments 14. Hot air meanwhile flows from manifold passage 98 into port 39 through chamber 34, holes 49, 57 and 58, and into slits 67A and 67B discharging as converging air sheets at or near the die tip apex 56. The converging air sheets contact the filaments discharging from the orifices and by drag forces stretch them and deposit them onto an underlying substrate 15 in a random position. This forms a generally uniform layer of meltblown material on the substrate.

In each of the flanking spiral nozzle module 12A, the polymer flows from manifold passage 87 through passage 38, through insert member 30, through port 32, through passage 134 of nozzle 130 (FIG. 11) discharging at the apex of cone 133. Air flows from manifold passage 98, passage 39 into chamber or cavity 34, through passages 136. Air discharging from passages 136 impart a swirling motion of the polymer issuing from passage 134. The polymer is deposited on the substrate as a circular or helical bead, giving good edge control for the adhesive layer deposited on the substrate.

Typical operational parameters are as follows:

| | |
|---|---|
| Polymer | Hot melt adhesive |
| Temperature of the Die and Polymer | 280° F. to 325° F. |
| Temperature of Air | 280° F. to 325° F. |
| Polymer Flow Rate | 0.1 to 10 grms/hole/min. |
| Hot Air Flow Rate | 0.1 to 2 SCFM/inch |
| Deposition | 0.05 to 500 g/m$^2$ |

As indicated above, the die assembly 10 may be used in meltblowing any polymeric material, but meltblowing adhesives is the preferred polymer. The adhesives include EVA's (e.g. 20–40 wt % VA). These polymers generally have lower viscosities than those used in meltblown webs. Conventional hot melt adhesives useable include those disclosed in U.S. Pat. Nos. 4,497,941, 4325,853, and 4,315,842, the disclosures of which are incorporated herein by reference. The preferred hot melt adhesives include SIS and SBS block copolymer based adhesives. These adhesives contain block copolymer, tackifier, and oil in various ratios. The above melt adhesives are by way of illustration only; other melt adhesives may also be used.

A variation of the modular die 10 is shown in FIG. 10. In this embodiment a pair of wide bead nozzles 12B are positioned at an internal location of the assembly shown in FIG. 2. This array of modules with three different applicator heads deposits a layer of meltblown (random filaments) onto the substrate with an internal wide bead for increased strength as required in diaper lamination, and flanking spiral beads for edge control.

Side-by-side mounting of the modules on the manifold is with reference to the adhesive deposition. The modules 12 may be in side-by-side juxtaposition forming a row of modules 12 of predetermined length over a substrate as illustrated in FIGS. 1, 2, and 10. In this arrangement, deposition of the adhesive would be as viewed in FIGS. 1, 2, and 10 wherein deposition of the modules in combination form a layer of adhesive on the substrate. It will be appreciated that this side-by-side deposition on the substrate can be achieved by mounting the modules on the manifold wherein some are displaced from one another in the machine direction, but not the cross direction. For example the modular die with internal meltblowing dies could be constructed so that the edge spray dies are positioned on opposite sides of the manifold (i.e. displaced in the MD from the meltblowing dies) but aligned so that there is no substantial overlap in the CD.

The present die construction features interchangeable nozzles that permit meltblowing and/or meltspraying airless head deposition in a single die construction. While the invention has been described with specific reference to certain nozzle combinations, there exists a wide range of combinations within the scope of this invention that are possible.

What is claimed is:

1. A modular die assembly for depositing a hot melt adhesive onto a substrate which comprises:

(a) a manifold having adhesive and air passages formed therein;

(b) a plurality of substantially identical modular die bodies mounted in side-by-side relation on the manifold, each die body being detachably mounted on the manifold, and having an adhesive passage and an air passage in fluid communication with the adhesive passage and air passage of the manifold exiting through a downwardly facing mounting surface;

(c) an air-assisted die head mounted on the mounting surface of each die body, said die heads each having an adhesive flow passage and an air passage formed therein in fluid communication with the adhesive flow passage and air flow passage, respectively, of the die body, said air-assisted die heads being selected from (i) meltblowing die heads wherein a plurality of filaments are discharged into converging sheets of air and deposited on the substrate as a generally uniform film, and (ii) spiral nozzle head wherein a monofilament is discharged from the die head into air jets and a spiral mono-filament bead is deposited on the substrate, said die heads being interchangeable, said modular die assembly comprising at least one of each type of air-assisted die head so that the adhesive pattern on the substrate comprises at least one meltblown film strip beside a spray monofilament bead strip.

2. The modular die assembly of claim 1 wherein the total number of die bodies ranges from 5 to 100 forming a row, and wherein the total number of meltblowing die heads ranges from 3 to 98 and the total number of spray nozzle heads ranges from 1 to 3.

3. The modular die assembly of claim 2 wherein the number of spray nozzle heads is 2 and each spray nozzle head is positioned at opposite ends of the row of die bodies, whereby the adhesive pattern on the substrate is uniform meltblown film flanked by helical pattern monofilament.

4. The modular die assembly of claim 1 and wherein a bead die head without air assistance is mounted on the mounting surfaces of at least one of the modular die bodies, whereby the assembly deposits on the substrate in side-by-side pattern a meltblown film strip, a swirled spray strip and a bead.

5. The modular die assembly of claim 1 wherein each die body module is from 0.25 to 1.5 inches in width and the assembly comprises from 5 to 100 of said die body modules.

6. The modular die assembly of claim 5 wherein each of the meltblowing die heads has spaced orifices distributed along its width, the orifice being from 0.01 to 0.040" in diameter.

7. The modular die assembly of claim 1 wherein each die body module includes a valve for selectively closing and opening the adhesive flow passage thereof.

8. A modular die for depositing a hot melt adhesive onto a substrate, comprising:

(a) a manifold having adhesive and air flow passages formed therein;

(b) first and second self-contained and inter-changeable die body modules mounted in side-by-side relationship on the manifold, each body module having (i) an adhesive flow passage and an air flow passage formed therein and in fluid communication with the adhesive and air flow passages, respectively, of the manifold, (ii) a mounting surface through which outlet the adhesive flow passage and air flow passage exists, and (iii) an air chamber formed in the module body and extending laterally on either side from where the polymer flow passage exits, and being in fluid communication with the air flow passage but not the polymer flow passage;

(c) a meltblowing die head mounted on the mounting surface of the first die body module and having (i) an adhesive flow passage in fluid communication with the adhesive flow passage exit of the first die body module, adhesive discharge means fed by the polymer flow passage for discharging a row of filaments, and (iii) air flow passages in fluid communication with the air flow passage exit of the first die body module, said die head being shaped to deliver converging air sheets from the meltblowing head on opposite sides of the row of filaments and deposit the same as a uniform film on the substrate; and (d) a spiral nozzle head mounted on the mounting surface of the second die body module and having (i) an adhesive flow passage in fluid communication with the adhesive flow passage exit of the first die body module, (ii) adhesive discharge means fed by the adhesive flow passage for discharging a monofilament, and (iii) air flow passage in fluid communication with the air flow passage exit of the second die module, said die head being shaped to deliver jets of air onto the monofilament to impart a swirling motion thereto and deposit the same on the substrate as a bead.

9. The modular die assembly of claim 8 and further comprising a third self-contained modular die body substantially identical to and interchangeable with the first and second die body modules and mounted on the manifold in alignment with the first and second die body modules, said third die body module having (a) an adhesive flow passage, and (b) a mounting surface through which one adhesive flow passage exits, and a bead die head without air assistance having an adhesive flow passage formed therein in registry with the adhesive flow passage of the die body module for depositing a linear bead of adhesive on the substrate.

10. A modular die for depositing an adhesive polymer onto a substrate, comprising:

(a) a plurality of self-contained and interchangeable die body modules mounted in side-by-side relationship, each body module having (i) a polymer flow passage formed therein, (ii) an air flow passage formed therein, (iii) a mounting surface having a polymer flow passage outlet and defining an air cavity, and (iv) an air chamber formed in the module body proximate the mounting surface and extending laterally on either side from the polymer flow passage outlet and being in fluid communication with the air passage but not the polymer flow passage;

(b) a plurality of die tip heads, each being mounted on a die body module mounting surface and comprising (i) a meltblowing die tip having a base mounted on the module body mounting surface and a triangular nosepiece protruding outwardly from the base in a direction away from the body module and terminating in an apex extending substantially the full width of the body module, said apex having formed therein polymer discharge means for discharging a row of filaments therefrom, said die tip having formed therein (a) a polymer flow passage in fluid communication with the polymer flow passage outlet of the die body module and being shaped to distribute the polymer laterally within the die tip for substantially the full width of the module and to deliver polymer to the polymer discharge means, and (b) air flow passages extending therethrough and in fluid communication with the air chamber formed in the body module, and (ii) air plates mounted on opposite sides of the nosepiece and therewith defining converging air slits, each air slit being in fluid communication with one of the air flow passage of the die tip; and (c) a spray nozzle mounted on at least one of the die body modules and having a polymer flow passage in fluid communication with the polymer flow passage outlet of at least one of said die body modules, and a plurality of air passages in fluid communication with the die body air chamber and extending through the nozzle and surrounding the nozzle polymer flow passage, the air passage being positioned to impart a swirling spiral motion to polymer discharging from the nozzle polymer flow passage and deposit a spiral bead onto the substrate.

11. The modular die of claim 10, and wherein at least one of the die body modules has mounted thereon (a) a nozzle in contact with the raised portion of the mounting surface, and having a polymer flow passage extending therethrough, and in fluid communication with the polymer flow passage outlet of the module body, and (b) a retainer plate for securing the nozzle to the mounting surface and sealing the air chamber.

* * * * *